US009717128B1

(12) United States Patent
Shih et al.

(10) Patent No.: US 9,717,128 B1
(45) Date of Patent: Jul. 25, 2017

(54) HIGH-SAFETY LED TUBE

(71) Applicant: Alfasemi Inc., Taipei (TW)

(72) Inventors: Te-Lung Shih, Taipei (TW); Yu-Cheng Chang, Cupertino, CA (US); Kuo-Chao Lin, Taipei (TW)

(73) Assignee: ALFASEMI INC., Taipei (TW)

( * ) Notice: Subject to any disclaimer, the term of this patent is extended or adjusted under 35 U.S.C. 154(b) by 0 days.

(21) Appl. No.: 15/060,666

(22) Filed: Mar. 4, 2016

(51) Int. Cl.

| | |
|---|---|
| ***H01J 7/44*** | (2006.01) |
| ***H05B 33/08*** | (2006.01) |
| ***F21K 9/278*** | (2016.01) |
| *F21Y 115/10* | (2016.01) |

(52) U.S. Cl.
CPC ..... *H05B 33/0884* (2013.01); *F21K 9/278* (2016.08); *H05B 33/0809* (2013.01); *H05B 33/0845* (2013.01); *F21Y 2115/10* (2016.08)

(58) Field of Classification Search
CPC ..... H01J 19/36; H01J 2893/0027; H01J 7/24; H01J 61/523; H01J 61/56; H01J 17/49; H01J 21/065; H01J 61/82; H01J 25/08; H01J 25/06; H01J 25/10; H01J 25/12; H01J 25/16; H01J 25/02; H01J 23/027; H01J 23/12; H01J 23/15; H04B 1/036; H05B 33/0815; H05B 33/0818; H05B 41/2828; H05B 41/3921; H05B 41/3927
USPC ..... 315/50–52, 291
See application file for complete search history.

(56) References Cited

U.S. PATENT DOCUMENTS

2011/0260622 A1* 10/2011 Hartikka ..... F21K 9/00 315/113
2013/0147350 A1* 6/2013 Yang ..... F21V 25/00 315/52
2015/0198290 A1* 7/2015 Segers ..... H05B 33/0827 315/191

* cited by examiner

*Primary Examiner* — Minh D A
(74) *Attorney, Agent, or Firm* — Bacon & Thomas, PLLC

(57) ABSTRACT

A high-safety LED tube, comprising: a first side having a first electrode and a second electrode; a second side having a third electrode and a fourth electrode; a first impedance module coupled to the first side; a second impedance module coupled to the second side; a first energy sensor having a first terminal coupled to the first impedance module; a second energy sensor having a first terminal coupled to the second impedance module; an LED unit coupled to the first impedance module and the second impedance module; a switch coupled to the LED unit; and a state control module coupled to the switch; wherein, when the first energy sensor or the second energy sensor detects an energy flowing between the first electrode and the second electrode or between the third electrode and the fourth electrode, the state control module turns on the switch.

16 Claims, 5 Drawing Sheets

HIGH-SAFETY LED TUBE

BACKGROUND OF THE INVENTION

1. Field of the Invention

The present invention relates to an LED tube, and more particularly, to improve the LED tube safety.

2. Description of Related Art

Currently, the existent ballasts are designed to work with compact fluorescent lamp (CFL). Due to operation theory of LED being different from that of fluorescent lamps, the LED tube needs special operation procedures to meet CFL/ballast safety standards. For example, if a LED lamp tube is directly installed to a live ballast and once a terminal of the LED lamp tube is connected to the ballast, and the other end is hold on hand. If ballast outputs enough voltage, LED can pass the current immediately and the operator could be shocked easily.

On contrast, under the same situation, CFL cannot pass the power easily because a CFL needs special ignition procedures to conduct power and operator would be safer to install CFL. And LED tube itself needs special designs to meet the current CFL/ballast safety standards and is safe to work with the existing ballasts and light fixtures.

Therefore, there is a need to improve LED tube safety standards to meet the safety regulations, so as to solve the aforementioned problems.

SUMMARY OF THE INVENTION

An object of the present invention is to provide a high-safety LED tube, which comprises: a first side having a first electrode and a second electrode; a second side having a third electrode and a fourth electrode; a first impedance module coupled to the first side; a second impedance module coupled to the second side; a first energy sensor having a first terminal coupled to the first impedance module; a second energy sensor having a first terminal coupled to the second impedance module; an LED unit coupled to the first impedance module and the second impedance module; a switch coupled to the LED unit; and a state control module coupled to the switch; wherein, when the first energy sensor or the second energy sensor detects an energy flowing between the first electrode and the second electrode or between the third electrode and the fourth electrode, the state control module turns on the switch. Thus, the high-safety LED tube can fit into existing fluorescent ballasts.

Another object of the present invention is to provide a high-safety LED tube, which comprises: a first side having a first electrode and a second electrode; a second side having a third electrode and a fourth electrode; a first impedance module coupled to the first electrode and the second electrode; a first impedance module coupled to the first electrode and the second electrode; an LED unit and a switch disposed on a first path coupled to the first impedance module and the second impedance module; a frequency sensor disposed on a second path coupled in parallel to the first path; the switch coupled to the LED unit; and a state control module coupled to the switch; wherein, when the frequency sensor detects a signal with a special frequency being existed between the first side and the second side, the state control module turns on the switch. Thus, the high-safety LED tube can fit into existing fluorescent ballasts, and based on the detection of the special frequency range.

DETAILED DESCRIPTION OF THE PREFERRED EMBODIMENT

Figure 1:
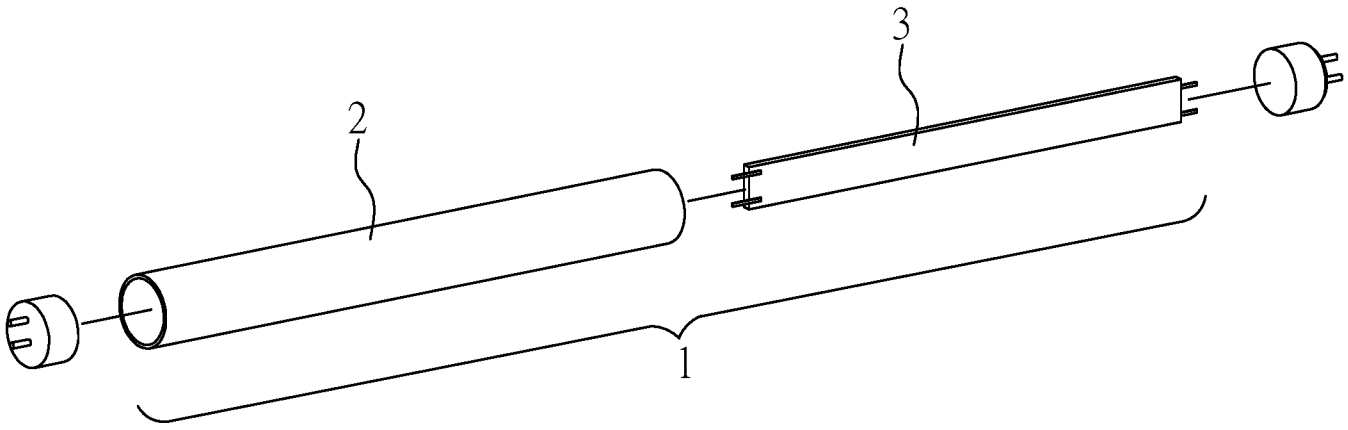
FIG. 1 is a schematic diagram illustrating the structure of a high-safety LED lamp device according to the invention.

FIG. 1 is a schematic diagram illustrating the structure of a high-safety LED lamp device 1 according to the invention. The high-safety LED lamp device 1 includes a lampshade 2 and an internal circuit device 3.

Figure 2:
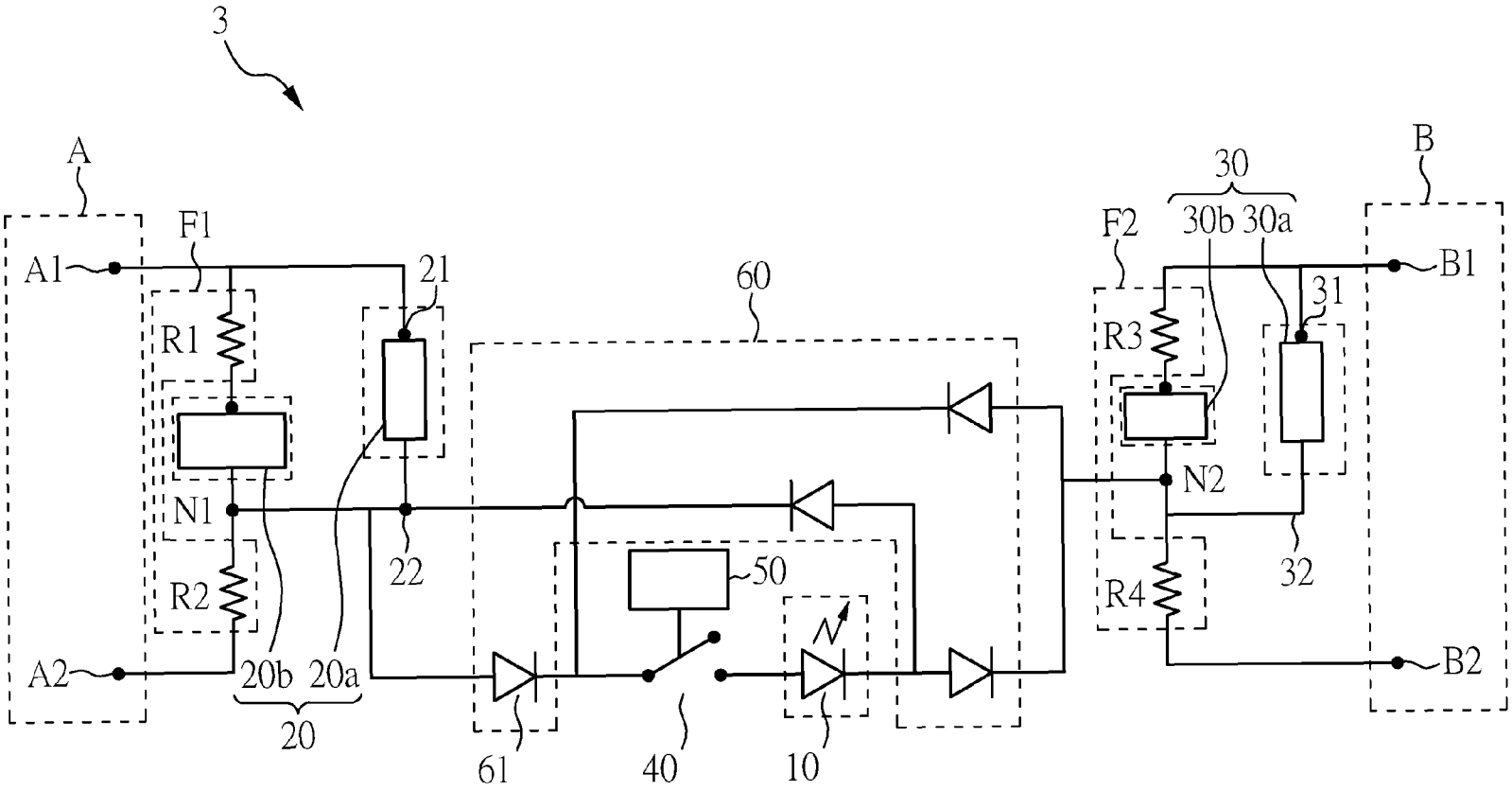
FIG. 2 is a schematic diagram illustrating a first type of the internal circuit according to the invention.

FIG. 2 is a schematic diagram illustrating a first type of the internal circuit 3 according to the invention. As shown, the first type of the internal circuit device 3 includes a first side A having a first electrode A1 and a second electrode A2; a second side B having a third electrode B1 and a fourth electrode B2, a first impedance module F1, a second impedance module F2, an LED unit 10, a first energy sensor 20, a second energy sensor 30, a switch 40 and a state control module 50.

It is noted that, the term "coupled" hereinafter used in the internal circuit device 3 of the invention may be representative of "directly connected" or "indirectly connected".

The first impedance module F1 has two terminals respectively coupled to the first electrode A1 and the second electrode A2. The second impedance module F2 has two terminals respectively coupled to the third electrode B1 and the fourth electrode B2. The LED unit 10 has an anode coupled to the first impedance module F1 and a cathode coupled to the second impedance module F2. The first energy sensor 20 has a first terminal 21 coupled to the first impedance module F1. The second energy sensor 30 has a first terminal 31 coupled to the second impedance module F2. The switch 40 is coupled to the LED unit 10. The state control module 50 is coupled to the switch 40 for controlling the switch 40. It is noted that the first impedance module F1 and the second impedance module F2 can be regarded as the filaments of a typical lamp.

The LED unit 10 can be one LED or a combination of a plurality of LEDs.

It is noted that, when a predetermined condition is satisfied, the state control module 50 turns the switch 40 on for lighting the LED unit 10. That is, the switch 40 is turned on only when the predetermined condition is satisfied. Preferably, the predetermined condition is that the first energy sensor 20 detects an energy flowing between the first electrode A1 and the second electrode A2, or the second energy sensor 30 detects an energy flowing between the third electrode B1 and the fourth electrode B2.

A bridge 60 is formed by diodes 61-64 converts the alternating current (AC) input into a direct current (DC) for LED operation. A full bridge is preferred but a half bridge also works.

In one embodiment, the first energy sensor 20 is a voltage sensor 20*a* or a current sensor 20*b* for detecting whether there is a voltage difference or a current flow existed between the first electrode A1 and the second electrode A2; i.e., the energy is the voltage difference or the current flow between the first electrode A1 and the second electrode A2. Similarly, the second energy sensor 30 is a voltage sensor 30*a* or a current sensor 30*b* for detecting whether there is a voltage difference or a current flow existed between the third electrode B1 and the fourth electrode B2; i.e., the energy is the voltage difference between the third electrode B1 and the fourth electrode B2.

In this embodiment, the first impedance module F1 is composed of a first impedance unit R1 and a second impedance unit R2. Preferably, one terminal of the first impedance unit R1 is directly connected to the first electrode A1, and the other terminal of the first impedance unit A1 is directly connected to one terminal of the second impedance unit R2, while the other terminal of the second impedance unit R2 is directly connected to the second electrode A2.

Similarly, the second impedance module F2 is composed of a third impedance unit R3 and a fourth impedance unit R4. Preferably, one terminal of the third impedance unit R3 is directly connected to the third electrode B1, and the other terminal of the third impedance unit R3 is directly connected to one terminal of the fourth impedance unit R4, while the other terminal of the fourth impedance unit R4 is directly connected to the fourth electrode B2.

In one embodiment, if the first energy sensor 20 is the voltage sensor 20*a*, it has a first terminal 21 directly connected to the first electrode A1, and a second terminal 22 directly connected to a terminal point N1 between the first impedance unit R1 and the second impedance unit R2, and thus the second terminal 22 is indirectly connected to the second electrode A2 via the second impedance unit R2.

Similarly, if the second energy sensor 30 is the voltage sensor 30*a*, it has a first terminal 31 directly connected to the third electrode B1, and a second terminal 32 directly connected to a terminal point N2 between the third impedance unit R3 and the fourth impedance unit R4, and thus the second terminal 32 is indirectly connected to the fourth electrode B4 via the fourth impedance unit R4.

If the first energy sensor 20 is the current sensor 20*b*, it is coupled between the first impedance unit R1 and a second impedance unit R2. Preferably, one terminal of the first impedance unit R1 is directly connected to the first electrode A1, and the other terminal of the first impedance unit R1 is directly connected to the first terminal 21 of the current sensor 20*b*. The second terminal 22 of the current sensor 20*b* is directly connected to one terminal of the second impedance unit R2, and the other terminal of the second impedance unit R2 is directly connected to the second electrode A2.

Similarly, if the second energy sensor 30 is the current sensor 30*b*, it is coupled between the third impedance unit R3 and the fourth impedance unit R4. Preferably, one terminal of the third impedance unit R3 is directly connected to the third electrode B1, and the other terminal of the third impedance unit R3 is directly connected to the first terminal 31 of the current sensor 30*b*. The second terminal 32 of the current sensor 30*b* is directly connected to the terminal of the fourth impedance unit R4, and the other terminal of the fourth impedance unit R4 is directly connected to the fourth electrode B2.

The terminal point N1 is coupled to the anode of the LED unit 10 through one end of the bridge 60, and the terminal point N2 is coupled to the cathode of the LED unit 10 through the other end of the bridge 60. The switch 40 and the LED unit 10 is disposed between the terminal points N1 and N2 through the bridge 60.

When both the first energy sensor 20 and the second energy sensor 30 do not detect the voltage difference or the current flow, the state control module 50 keeps the switch 40 off, and the internal circuit device 3 is in an open circuit state. As long as one of the first energy sensor 20 and the second energy sensor 30 detects the voltage difference or the current flow, the state control module 50 will turn on the switch 40.

Besides, the internal circuit device 3 is not limited by that both the first energy sensor 20 and the second energy sensor 30 are the same type sensor together, both be voltage sensors 20*a*, 30*a* or be current sensors 20*b*, 30*b*. Alternatively, for example, the first energy sensor 20 can be the voltage sensor, and the second energy sensor 30 can be the current sensor, and vice versa.

Figure 3:
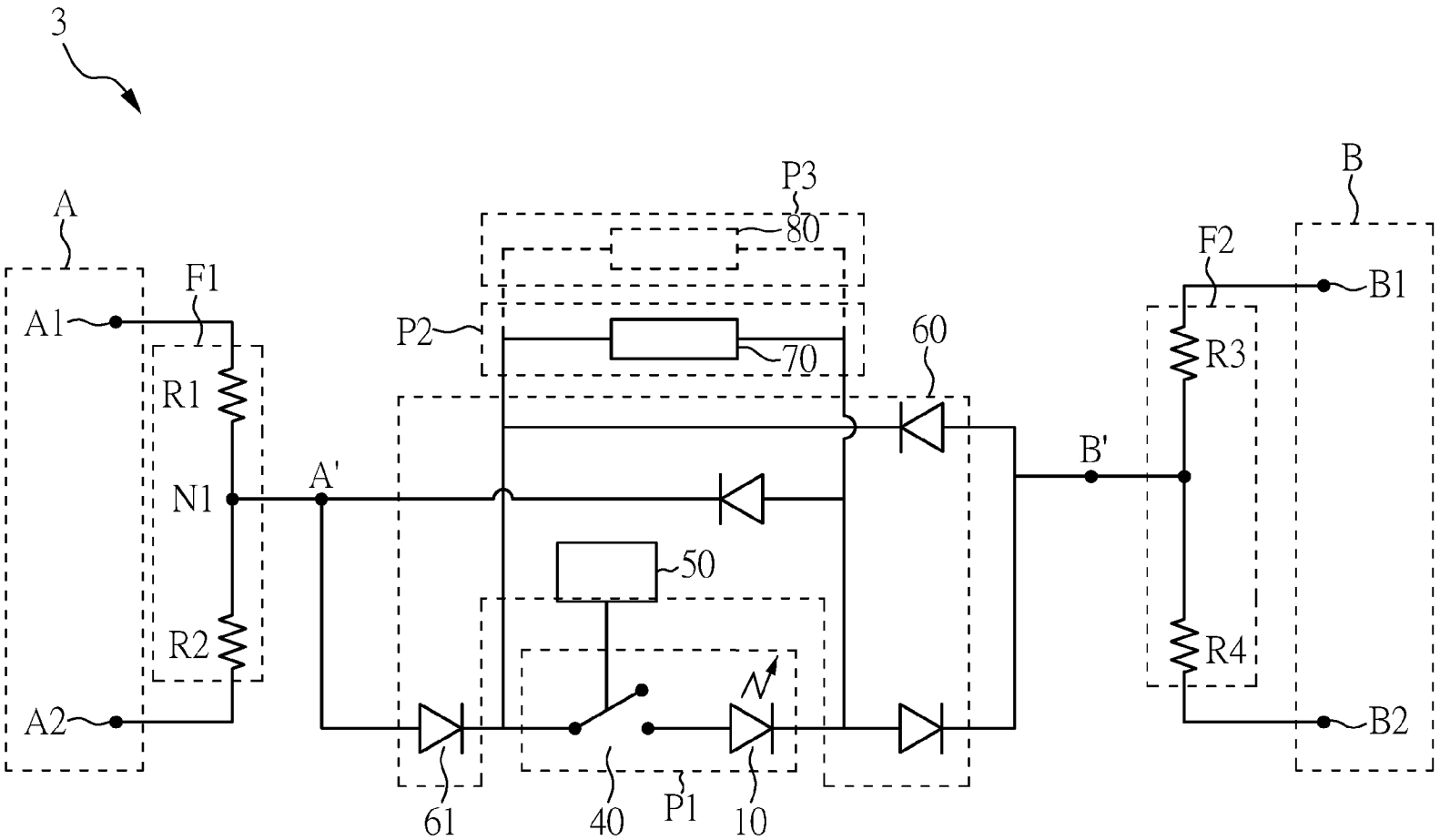
FIG. 3 is a schematic diagram illustrating a second type of the internal circuit according to the invention.

FIG. 3 is a schematic diagram of a second type of the internal circuit device 3 according to the invention. With reference to both FIG. 3 and FIG. 2, similar to the first type of the internal circuit device 3, the second type of the internal circuit device 3 also comprises the first side A having the first terminal A1 and the second terminal A2, the second side B having the third terminal B1 and the second terminal B2, the first impedance module F1, the second impedance module F2, the LED unit 10, the switch 40 and the state control module 50. Besides, the internal circuit device 3 of the second type further includes a frequency sensor 70.

The arrangements of the first side A, the second side B, the first impedance module F1, the second impedance module F2, the switch 40 and the LED unit 10 are the same as those of the first type, and thus a detailed description therefor is deemed unnecessary.

Besides, to similar with the first type, diodes 61-64 form a bridge 60.

In one embodiment, the frequency sensor 70 is disposed on a second path P2 connected in parallel to a first path P1 having the LED unit 10. That is, the frequency sensor 70 is connected in parallel to the LED unit 10.

The frequency sensor 70 is provided to detect whether a signal with a special frequency range is existed between the first side A and the second side B. If the frequency sensor 70 detects the signal with the special frequency range, the state control module 50 turns on the switch 40. Preferably, the special frequency range is not lower than 1 KHz.

Besides, the frequency sensor 70 detecting the signal with the special frequency range being existed between the first side A and the second side B is representative of the frequency sensor 70 detecting the signal with the special frequency range being existed between an equivalent node A' of the first side A and an equivalent node B' of the second side B.

Therefore, when the frequency sensor 70 detects a signal with a frequency lower than 1 KHz, the state control module 50 keeps turning off the switch 40. When the frequency sensor 70 detects a signal with a frequency not lower than 1 KHz, the state control module 50 turns on the switch 40.

In another embodiment, in addition to having the frequency sensor 70 and the precedent circuit structure, the internal circuit device 3 further includes an ultra-high voltage sensor 80 disposed on a third path P3 connected in parallel to the second path P2. The ultra-high voltage sensor 80 is used to detect if a voltage difference between the first side A and the second side B is over a specific value.

When the ultra-high voltage sensor 80 detects if the voltage difference between the first side A and the second side B is over a specific value, the state control module 50 will turn on the switch 40.

Similarly, the ultra-high voltage sensor 80 detecting the voltage difference between the first side A and the second side B represents the ultra-high voltage sensor 80 detecting the voltage difference between the equivalent node A' of the first side A and the equivalent node B' of the second side B. Besides, the specific value is preferred to be not lower than 1 KV.

Hence, when the ultra-high voltage sensor 80 detects a voltage difference is lower than 1 KV, the state control module 50 keeps turning off the switch 40. When the ultra-high voltage sensor 80 detects a voltage difference is over 1 KV, the state control module 50 will turn on the switch 40.

It is noted that, in this embodiment, as long as the frequency sensor 70 detects the signal with the special frequency or the ultra-high voltage sensor 80 detects the specific value, the state control module 50 turns on the switch 40.

Figure 4:
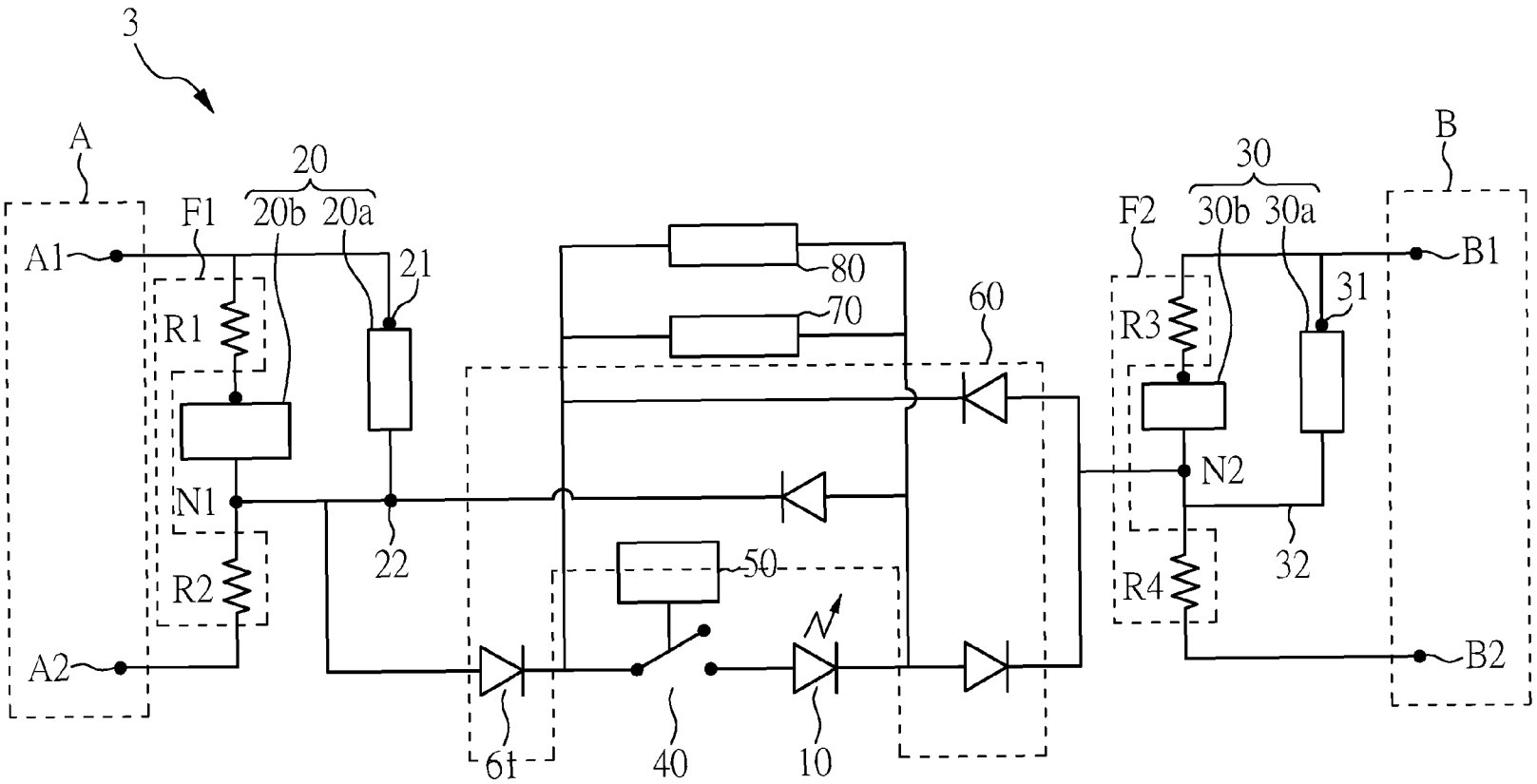
FIG. 4 is a schematic diagram illustrating a third type of the internal circuit 3 according to the invention.

FIG. 4 is a schematic diagram of a third type of the internal circuit device 3 according to the invention. With reference to FIG. 2, FIG. 3, and FIG. 4, similar to the first type of the internal circuit devices 3 shown in FIG. 2 and the second type of the internal circuit device 3 shown in FIG. 3, the third type of the internal circuit device 3 also comprises the first side A having the first terminal A1 and the second terminal A2, the second side B having the third terminal B1 and the second terminal B2, the first impedance module F1, the second impedance module F2, the LED unit 10, the switch 40 and the state control module 50. In addition, the third type of the internal circuit device 3 includes the first energy sensor 20, the second energy sensor 30, the frequency sensor 70 and the ultra-high voltage sensor 80.

The arrangements of the first side A, the second side B, the first impedance module F1, the second impedance module F2, the switch 40 and the LED unit 10 are the same as the first type and the second type, and thus a detailed description is deemed unnecessary.

Similar to the first type, the first energy sensor 20 or the second energy sensor 30 can be the voltage sensor. When the first energy sensor 20 is the voltage sensor, the first terminal 21 of the first energy sensor 20 is directly connected to the first electrode A1, and the second terminal 22 of the first energy sensor 20 is indirectly connected to the second electrode A2 via the second impedance unit R2. When the second energy sensor 30 is the voltage sensor, the first terminal 31 of the second energy sensor 30 is directly connected to the third electrode B1, and the second terminal 32 of the second energy sensor 30 is indirectly connected to the fourth electrode B2 via the fourth impedance unit R4.

Similar to the first type, the first energy sensor 20 or the second energy sensor 30 can be the current sensor. When the first energy sensor 20 is the current sensor, the first energy sensor 20 is directly connected between the first impedance unit R1 and the second impedance unit R2. When the second energy sensor 30 is the current sensor, the second energy sensor 30 is directly connected between the third impedance unit R3 and the fourth impedance unit R4.

Similar to the second type, the frequency sensor 70 is also disposed on the second path P2 connected in parallel to the first path P1 having the switch 40 and the LED unit 10. Besides, the ultra-high voltage sensor 80 is disposed on the third path P3 connected in parallel to the third path P3.

In the third type, when the first energy sensor 20 detects the energy flowing between the first electrode A1 and the second electrode A2, when the second electrode energy sensor 30 detects the energy flowing between the third electrode B1 and the fourth electrode B2, when the frequency sensor 70 detects the signal with the special frequency range between the first side A and the second side B, or when the ultra-high voltage sensor detects the voltage difference between the first side A and the second side B, the state control module 50 turns on the switch 40. It is noted that, as long as one of the conditions is satisfied, the state control module 50 turns on the switch 40.

Besides, in one embodiment, the ultra-high voltage sensor 80 and the third path P3 can be removed; i.e., the internal circuit device 3 only has the first and second energy sensors 20, 30 and the frequency sensor 70.

In addition, in one embodiment, the first energy sensor 20 and the second energy sensor 30 are different sensors; e.g., one is the voltage sensor and the other one is the current sensor.

Figure 5:
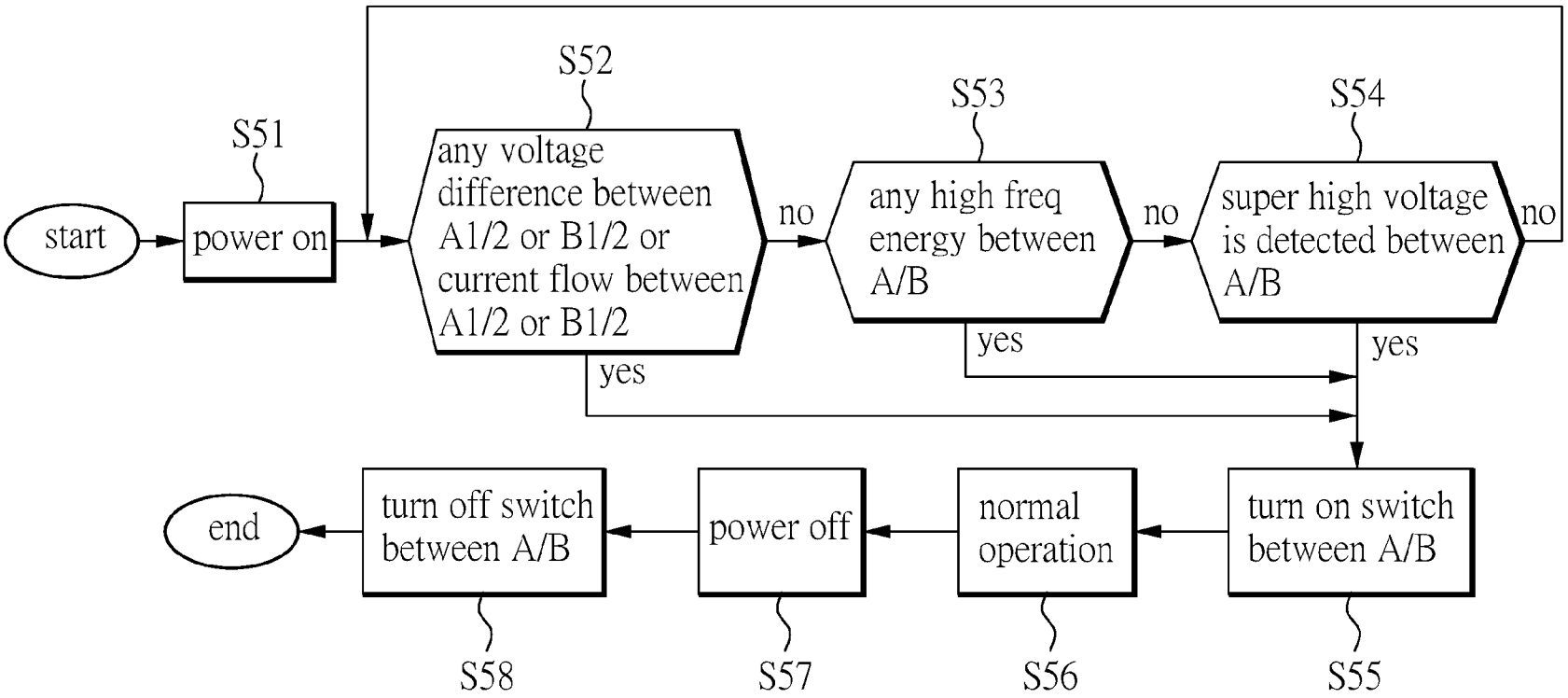
FIG. 5 is an operating flow diagram for the third type of the internal circuit 3 of the invention.

FIG. 5 is an operating flow diagram for the complete of the internal circuit device 3 according to the invention. First, step S51 is executed to power on the high-safety LED tube, in which an external power is inputted into the internal circuit device 3 via the first electrode A1 and the second electrode A2 or via the third electrode B1 and the fourth electrode B2 and, at this moment, the switch 40 is turned off or kept off. Then, step S52 is executed, in which the first energy sensor 20 or the second energy sensor 30 detects whether there is energy flowing between the first electrode A1 and the second electrode A2 or between the third electrode B1 and the fourth electrode B2 and, if any energy format is detected between the electrodes A1 and A2 or between the electrodes B1 and B2, the state control module 50 turns on the switch 40; otherwise, step S53 is executed. In step S53, the frequency sensor 70 detects whether the signal with the special frequency range is existed between the first side A and the second side B and, if a signal with special frequency range is detected, the state control module 50 turns on the switch 40; otherwise, step S54 is executed. In step S54, the ultra-high voltage sensor 80 detects whether the voltage with the specific value is existed between the first side A and the second side B, if a ultra-high potential difference is built between the first side A and the second side B, the state control module 50 turns on the switch 40; otherwise, process keeps looping steps S52 to S54. After the switch 40 is turned on (Step S55), step S56 is executed, and the internal circuit device 3 operates normally. After being powered off (step S57), step S58 is executed, in which the state control module 50 turns off the switch 40.

It is noted that, the sequence of the steps S52 to S54 to be executed is for illustrative purpose only and, in actual application, the sequence of the steps S52 to S54 to be executed can be changed.

It would be ok to remove either step S52, S53 or S54 according to the hardware implementations. For example, if ultra-high voltage sensor 80 is not built in FIG. 2, the corresponding step S54 could be removed, and vice versa.

Accordingly, the invention provides a high-safety LED tube capable of providing a plurality of safety check mechanisms to allow the high-safety LED lamp tube to fit to all existent ballasts and to satisfy the safe regulation.

Although the present invention has been explained in relation to its preferred embodiments, it is to be understood that many other possible modifications and variations can be made without departing from the spirit and scope of the invention as hereinafter claimed.

What is claimed is:

1. A high-safety LED tube, comprising:

a first side having a first electrode and a second electrode;

a second side having a third electrode and a fourth electrode;

a first impedance module coupled to the first side;

a second impedance module coupled to the second side;

a first energy sensor having a first terminal coupled to the first impedance module;

a second energy sensor having a first terminal coupled to the second impedance module;

an LED unit coupled to the first impedance module and the second impedance module;

a switch coupled to the LED unit; and a state control module coupled to the switch;

wherein, when the first energy sensor or the second energy sensor detects an energy flowing between the first electrode and the second electrode or between the third electrode and the fourth electrode, the state control module turns on the switch;

wherein the first impedance module includes a first impedance unit and a second impedance unit, and the second impedance module includes a third impedance unit and a fourth impedance unit; the first energy sensor and the second energy sensor are each a voltage sensor; the energy is a voltage difference between the first electrode and the second electrode or a voltage difference between the third electrode and the fourth electrode.

2. The high-safety LED tube of claim 1, further comprising a rectifier module including at least one diode coupled to the LED unit.

3. The high-safety LED tube of claim 1, wherein the first terminal of the first energy sensor is further coupled to the first electrode, a second terminal of the first energy sensor is coupled to the second electrode via the second impedance unit.

4. The high-safety LED tube of claim 1, wherein the first impedance module further comprises a first node between the first impedance unit and the second impedance unit, the second impedance module further comprises a second node between the third impedance unit and the fourth impedance unit, the first node is coupled to an anode of the LED unit, the second node is coupled to a cathode of the LED unit.

5. A high-safety LED tube, comprising:

a first side having a first electrode and a second electrode;

a second side having a third electrode and a fourth electrode;

a first impedance module coupled to the first electrode and the second electrode;

a second impedance module coupled to the third electrode and the fourth electrode;

an LED unit disposed on a first path coupled to the first impedance module and the second impedance module;

a frequency sensor disposed on a second path connected in parallel to the first path;

a switch coupled to the LED unit; and a state control module coupled to the switch;

wherein, when the frequency sensor detects a signal with a special frequency being existed between the first side and the second side, the state control module turns on the switch.

6. The high-safety LED tube of claim 5, wherein the special frequency is not lower than 1 KHz.

7. The high-safety LED tube of claim 5, further comprising a rectifier module including at least one diode coupled to the LED unit.

8. The high-safety LED tube of claim 5, wherein the frequency sensor detecting the signal with the special frequency being existed between the first side and the second side is representative of the frequency sensor detecting the signal with the special frequency being existed between an equivalent node of the first side and an equivalent node of the second side.

9. The high-safety LED tube of claim 5, wherein the LED unit is connected in series to the switch on the first path.

10. The high-safety LED tube of claim 5, wherein the first impedance module includes a first impedance unit and a second impedance unit, and the second impedance module includes a third impedance unit and a fourth impedance unit.

11. The high-safety LED tube of claim 10, wherein the first impedance module further comprises a first node between the first impedance unit and the second impedance unit, the second impedance module further comprises a second node between the third impedance unit and the fourth impedance unit, the first node is coupled to an anode of the LED unit, and the second node is coupled to a cathode of the LED unit.

12. The high-safety LED tube of claim 5, further comprising an ultra-high voltage sensor disposed on a third path connected in series to the second path.

13. The high-safety LED tube of claim 12, wherein when the ultra-high voltage sensor detects if a voltage difference between the first side and the second side is over a specific value, the state control module turns on the switch.

14. The high-safety LED tube of claim 13, wherein the specific value is not lower than 1 KV.

15. The high-safety LED tube of claim 5, further comprising a first energy sensor with a terminal coupled to the first impedance module and a second energy sensor with a terminal coupled to the first impedance module.

16. A high-safety LED tube, comprising:

a first side having a first electrode and a second electrode a second side having a third electrode and a fourth electrode;

a first impedance module coupled to the first side;

a second impedance module coupled to the second side;

a first energy sensor having a first terminal coupled to the first impedance module;

a second energy sensor having a first terminal coupled to the second impedance module;

an LED unit coupled to the first impedance module and the second impedance module;

a switch coupled to the LED unit; and a state control module coupled to the switch;

wherein, when the first energy sensor or the second energy sensor detects an energy flowing between the first electrode and the second electrode or between the third electrode and the fourth electrode, the state control module turns on the switch;

wherein the first impedance module includes a first impedance unit and a second impedance unit, and the second impedance module includes a third impedance unit and a fourth impedance unit; the first energy sensor and the second energy sensor are each a current sensor; a first terminal of the first energy sensor is directly connected to the first impedance unit, a second terminal of the first energy sensor is directly connected to the second impedance unit.

* * * * *